US005148181A

United States Patent [19]

Yokoyama et al.

[11] Patent Number: 5,148,181

[45] Date of Patent: Sep. 15, 1992

[54] MOBILE RADIO COMMUNICATION APPARATUS

[75] Inventors: Yukio Yokoyama; Takao Ono, both of Tokyo, Japan

[73] Assignee: NEC Corporation, Tokyo, Japan

[21] Appl. No.: 624,599

[22] Filed: Dec. 10, 1990

[30] Foreign Application Priority Data

Dec. 11, 1989 [JP] Japan ..... 1-318788

[51] Int. Cl.[5] ..... H01Q 1/24

[52] U.S. Cl. ..... 343/702; 343/700 MS

[58] Field of Search ..... 343/702, 713, 700 MS; 455/89

[56] References Cited

U.S. PATENT DOCUMENTS

| | | | |
|---|---|---|---|
| 4,641,366 | 2/1987 | Yokoyama et al. | 343/702 |
| 4,700,194 | 10/1987 | Ogawa et al. | 343/700 MS |
| 4,791,423 | 12/1988 | Yokoyama et al. | 343/702 |
| 4,803,491 | 2/1989 | Hikuma | 343/702 |
| 4,829,591 | 5/1989 | Hashimoto et al. | 455/89 |

FOREIGN PATENT DOCUMENTS

| | | |
|---|---|---|
| 0176311 | of 1985 | European Pat. Off. . |
| 0246026 | of 1987 | European Pat. Off. . |
| 1333842 | of 1971 | United Kingdom . |
| 2147744 | of 1984 | United Kingdom . |

*Primary Examiner*—Michael C. Wimer

*Assistant Examiner*—Hoanganh Le

*Attorney, Agent, or Firm*—Leydig, Voit & Mayer

[57] ABSTRACT

A mobile radio communication apparatus with an improved antenna for promoting easy manual operations, insuring desirable acoustic characteristics, and preventing the antenna gain from being lowered by user's head or hand during communication. An antenna is mounted on the upper surface of a casing and made up of a rectangular first conductive plate parallel to and spaced apart from the upper surface by a predetermined distance and having a length $L_1$, a rectangular second conductive plate extending perpendicularly from the first conductive plate and having a height $H_2$, and a rectangular third conductive plate extending perpendicularly from the second conductive plate and in parallel to the first conductive plate. A short-circuiting plate extending perpendicularly from one side of the first conductive plate by a height $H_1$ and has a length M as measured in a direction parallel to the length $L_1$. The short-circuiting plate has the end thereof connected and affixed to the upper end of a particular surface of the casing where the earpiece, mouthpiece and operation secton are arranged. The height $H_1$ of the short-circuiting plate is greater than said height $H_2$ of the second conductive plate, while the length M of the short-circuiting plate is equal to or smaller than the length $L_1$ of the first conductive plate.

6 Claims, 8 Drawing Sheets

MOBILE RADIO COMMUNICATION APPARATUS

BACKGROUND OF THE INVENTION

The present invention relates to a mobile radio communication apparatus and, more particularly, to a mobile radio communication apparatus having an improved antenna.

A mobile radio communication apparatus is extensively used today and implemented as an on-board telephone for vehicle use or a paging receiver by way of example. Generally, this kind of apparatus has a flat microstrip antenna which is short-circuited at one side thereof. Specifically, the microstrip antenna is mounted on the back or the top of the casing of the apparatus and extends in parallel to and at a predetermined spacing from the latter. The antenna has a flat rectangular conductive plate for radiation, a short-circuiting plate for short-circuiting the conductive plate and the casing which serves a grounding function, and a feed conductor. The resonance frequency of the antenna generally varies with the width of the conductive plate and that of the short-circuiting plate. By taking account of this characteristic, it has been customary to so select the individual widths as to set up a desired resonance frequency and to reduce the width of the conductive plate as far as possible. Assuming the application of the microstrip antenna to 900 MHz, for example, it has been impractical to reduce the width of the conductive plate to less than $\lambda/8$ wavelength, i.e. about 40 mm. However, even the antenna having such a small conductive plate occupies a substantial space at the back or on the top of the casing of the apparatus and is contradictory to the current trend toward to the miniaturization of a mobile radio communication apparatus. Another problem with this type of conventional antenna is that the antenna gain decreases when the antenna is held by hand or when the hand is brought close to the antenna. In addition, the manipulability achievable with such a conventional antenna is not satisfactory.

SUMMARY OF THE INVENTION

It is therefore an object of the present invention to provide a mobile radio communication apparatus with an improved antenna which promotes easy manual operations, insures desirable acoustic characteristics, and prevents the antenna gain from being lowered by user's head or hand.

It is another object of the present invention to provide a generally improved mobile radio communication apparatus.

A mobile radio communication apparatus of the present invention comprises a casing having an earpiece, a mouthpiece and an operating section arranged on any desired surface thereof an antenna mounted on the upper surface of the casing and comprising a first conductive plate parallel to and spaced apart from the upper surface by a predetermined distance and having a length $L_1$, a second conductive plate extending perpendicularly from the first conductive plate and having a height $H_2$, and a third conductive plate extending perpendicularly from the second conductive plate and in parallel to the first conductive plate, a short-circuiting plate extending perpendicularly from one side of the first conductive plate by a height $H_1$ and having a length M as measured in a direction parallel to the length $L_1$, the short-circuiting plate having the end thereof connected and affixed to the upper end of the desired surface of the casing, and a feed conductor connected to the antenna.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
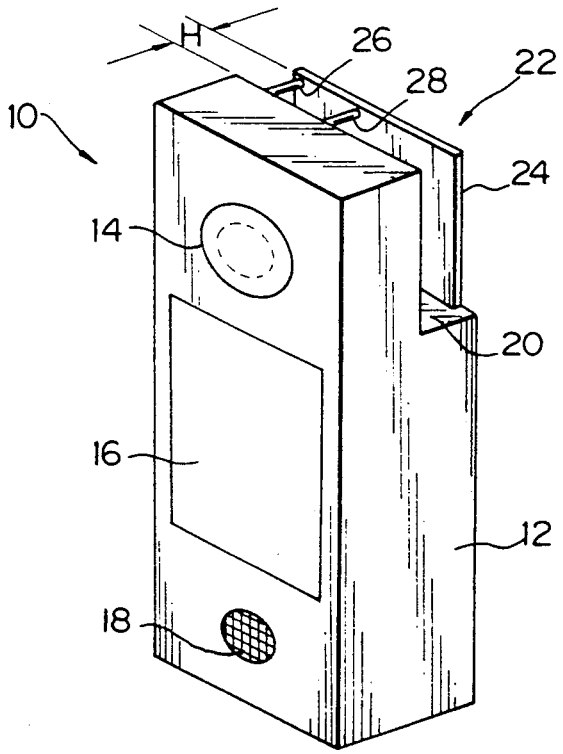
Fig. 1 PRIOR ART
FIG. 1 is an external perspective view of a mobile radio communication apparatus having a prior art antenna.

To better understand the present invention, a brief reference will be made to a prior art mobile radio communication apparatus, shown in FIG. 1. As shown, the prior art apparatus, generally 10, is implemented as a portable radio communication apparatus and has a casing 12. The casing 12 has an earpiece 14, an operating section 16, and a mouthpiece 18 located at predetermined positions on the front surface thereof. A recess or space 20 is provided on the back of the casing 12 and extends from the upper end to an intermediate portion of the casing 12. A microstrip antenna 22 is accommodated in the space 20 and short-circuited at one side thereof.

Figure 2:
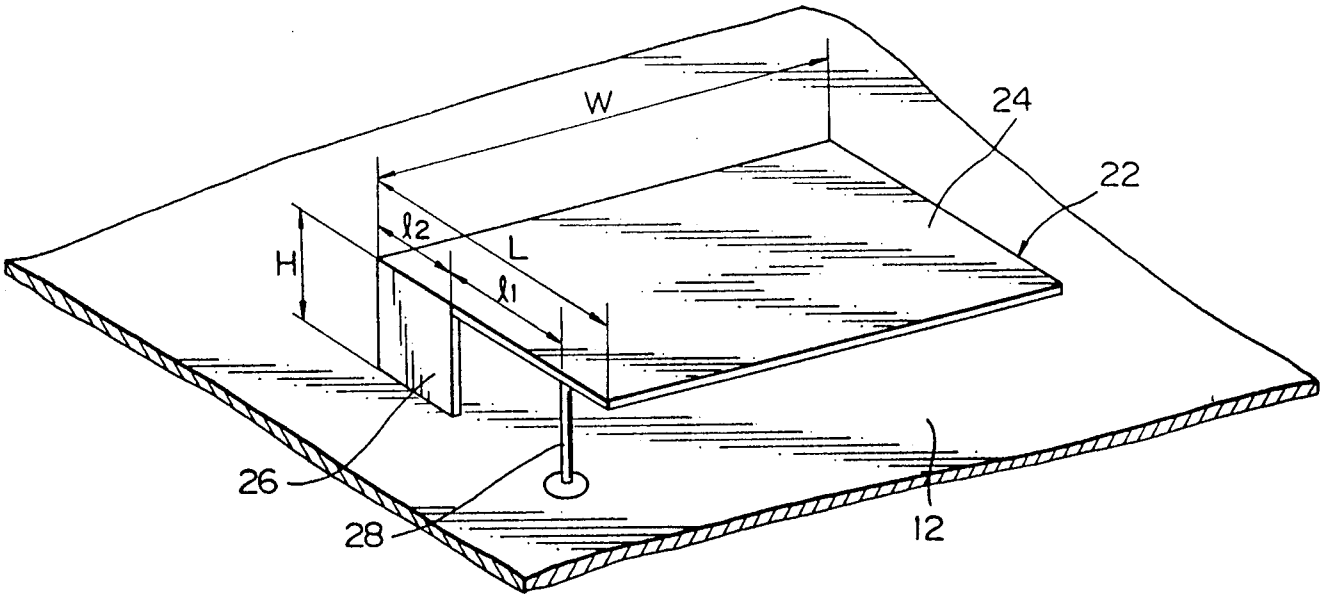
Fig.2 PRIOR ART
FIG. 2 is an enlarged perspective view showing the prior art antenna of FIG. 1 in detail.

Specifically, as shown in FIG. 2, the microstrip antenna 22 has a flat rectangular conductive plate for radiation 24 which extends in parallel to the casing, or grounding member 12, while being spaced apart from the latter by a predetermined distance H. The conductive plate 24 has one side portion thereof partly removed and the rest of that portion bent to form a short-circuiting plate 26. The short-circuiting plate 26 short-circuits the conductive plate 24 and the casing 12. Further, the antenna 22 has a feed conductor 28 which is spaced apart from the short-circuiting plate 26 by a predetermined distance $l_1$. The resonance frequency of the antenna 22 is determined by the dimension or width W of one side of the conductive plate 24. It is generally accepted that the width W should be about $\lambda/4$ wavelength. Then, assuming that the antenna 22 is adapted for a 900 MHz application, the width W should be about 80 mm. On the other hand, the resonance frequency decreases with the decrease in the dimension or length $l_2$ of the short-circuiting plate 26 as measured in a direction perpendicular to the width W. The width W of the conductive plate 24, therefore, can be reduced to about λ/8 wavelength. Specifically, when the antenna 22 is adapted for the frequency of 900 MHz, the width W can be reduced to about 40 mm. The height of the antenna 22 or that of the short-circuiting plate 26, i.e., the distance H between the conductive plate 24 and the casing 12 should preferably be about λ/20 wavelength, as also accepted in the art. Then, assuming the 900 MHz application of the antenna 22, the height H should preferably be about 16 mm. In any case, the relative bandwidth broadens as the dimension or length L of the other side of the conductive plate 22 increases.

As stated above, the prior art antenna 22 of the type to which the present invention pertains has to be provided with the conductive plate 24 having a width W which is at least λ/4 to λ/8 wavelength (assuming the 900 MHz application, 80 to 40 mm). The antenna 22, therefore, occupies a substantial space on the back of the casing 12. This is contradictory to the current trend toward a more miniature radio communication apparatus. Another problem with this type of antenna is that the antenna gain decreases when the antenna 22 is held by hand or when the user's hand is brought close to the antenna 22.

Figure 4:
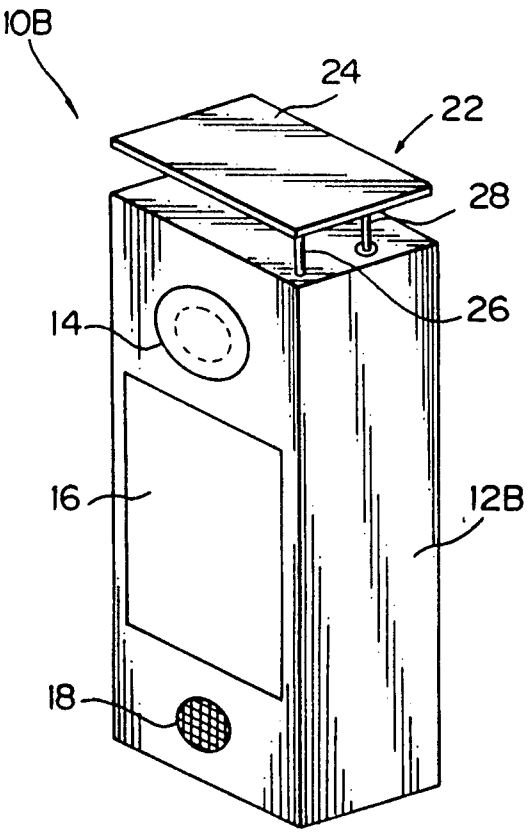
Fig.4 PRIOR ART
FIGS. 3 and 4 are external perspective views each showing a mobile radio communication apparatus with another prior art antenna.
Figure 3:
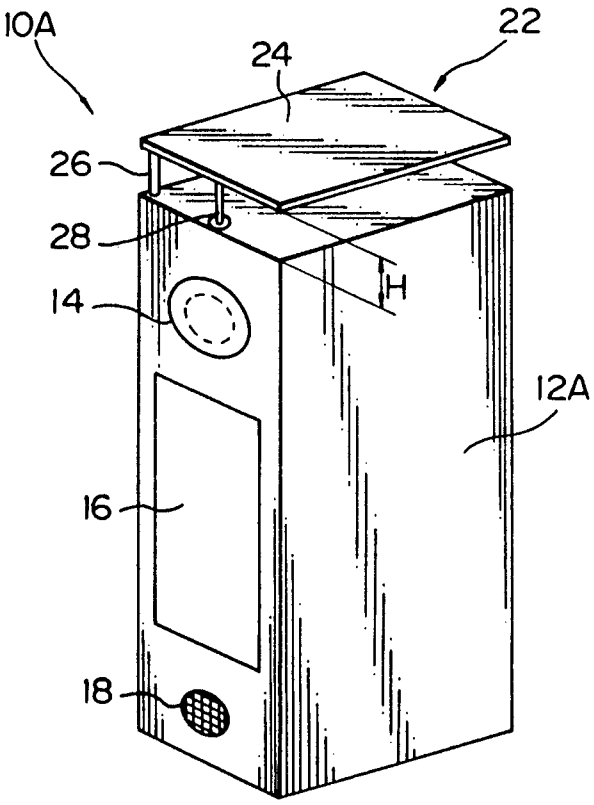
Fig.3 PRIOR ART

FIGS. 3 and 4 show respectively other prior art radio communication apparatuses 10A and 10B each being designed to eliminate the above problems. As shown, the apparatuses 10A and 10B each has the antenna 22 located on the top of a casing 12A or 12B thereof. The casing 12A of the apparatus 10A shown in FIG. 3 has a smaller front surface and a larger side surface than the casing 12 of the apparatus 10, FIG. 1. The height H of the antenna 22 provided on the top of such a casing 12A is about λ/20 wavelength, i.e., about 16 mm in the case of a 900 MHz application. Hence, even when user holds an upper portion of the casing 12A by hand, the hand will not cover the antenna 22. The apparatus 10A, however, brings about another problem that the lateral dimension or width of the front surface of the casing 12A is too small for the user's ear to remain in tight contact with the earpiece 14, degrading the acoustic characteristics. In addition, the operating section 16 provided on the casing 12A is not easy to operate since the area thereof is also small. The apparatus 10B shown in FIG. 4 constitutes an improvement over the apparatus 10A. However, the apparatus 10B is not fully acceptable since when the user's ear is put on the earpiece 14, the user's head causes the antenna gain to noticeably decrease.

Figure 5:
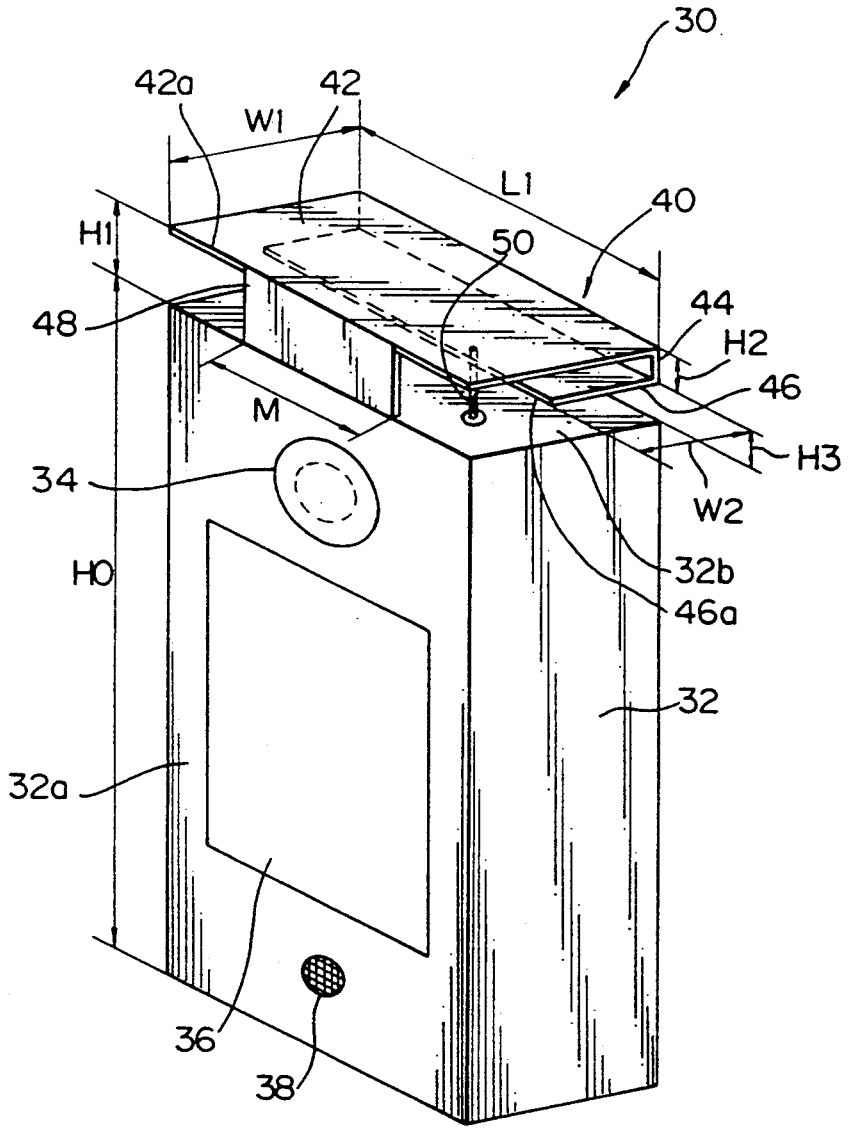
FIG. 5 is an external perspective view of a mobile radio communication apparatus with an improved antenna embodying the present invention.

Referring to FIG. 5, a mobile ratio communication apparatus embodying the present invention is shown and generally designated by the reference numeral 30. Also implemented as a portable radio communication apparatus, the apparatus 30 has a casing 32 having a height $H_0$. An earpiece 34, an operating section 36 and a mouthpiece 38 are arranged in predetermined positions on any desired surface of the casing 32 (referred to as a front surface **32*a* hereinafter). An antenna 40 is mounted on the upper surface 32*b* of the casing 32. The antenna 40 is formed by bending a flat conductive plate in the form of a letter U. Specifically, the antenna 40 has a first conductive plate 42, a second conductive plate 44, and a third conductive plate 46 which are contiguous with one another. The first conductive plate 42 has the same length $L_1$ and width $W_1$ as the upper surface 32*b* of the casing 32 and extends in parallel to the upper surface 32*b* while being spaced apart from the latter by a distance $H_1$. The second conductive plate 44 extends perpendicularly downward from the first conductive plate 42 toward the casing 32 and has a height $H_2$. The third conductive plate 46 extends from and perpendicularly to the second conductive plate 44 and in parallel to the first conductive plate 42. The third conductive plate 46** has a width $W_2$.

A flat short-circuiting plate 48 extends perpendicularly downward from one side **42*a* of the first conductive plate 42 toward the casing 32 and has a length M. While the short-circuiting plate 48 is shown as extending over a part of the side 42*a* of the conductive plate 42, it may alternatively extend over the entire side 42*a*, if desired. The short-circuiting plate 42 is affixed to the front end 32*a* of the casing 32 and equal in height to the entire antenna 40, i.e. $H_1$. The height $H_2$ of the second conductive plate 44 is selected to be smaller than the height $H_1$ of the antenna 22, so that the third conductive plate 46 may not contact the upper surface 32*b* of the casing 32. Since the length M of the short-circuiting plate 48 is equal to or smaller than the length $L_1$ of the first conductive plate 42, one side 42*a* of the plate 42 is either entirely or partly short-circuited by the plate 48. A feed conductor 50 is located at a predetermined distance from the short-circuiting plate 48 and in a position which insures impedance matching of a transmitter/-receiver included in the apparatus 30**.

The resonance frequency of the antenna 30 is determined by the overall width of the generally U-shaped conductive plates, i.e. $W_1+H_2+W_2$. The greater the overall width, the lower the resonance frequency is. The resonance frequency depends also on the length M of the short-circuiting plate 48 or the distance $H_2$ between the third conductive plate 46 and the upper surface **32*b* of the casing 32. Specific dimensions of the antenna 30** which implement a desired resonance frequency are shown below, assuming the 900 MHz application and λ=333 mm.

$$W_1=\lambda_0/14=23 \text{ mm}$$

$$L_1=\lambda_0/6=50 \text{ mm}$$

$$W_2=\lambda_0/33=10 \text{ mm}$$

$$H_1=\lambda_0/25=13.5 \text{ mm}$$

$$H_3=\lambda_0/160=2 \text{ mm}$$

$$H_0=\lambda_0/2=165 \text{ mm}$$

Figure 6:
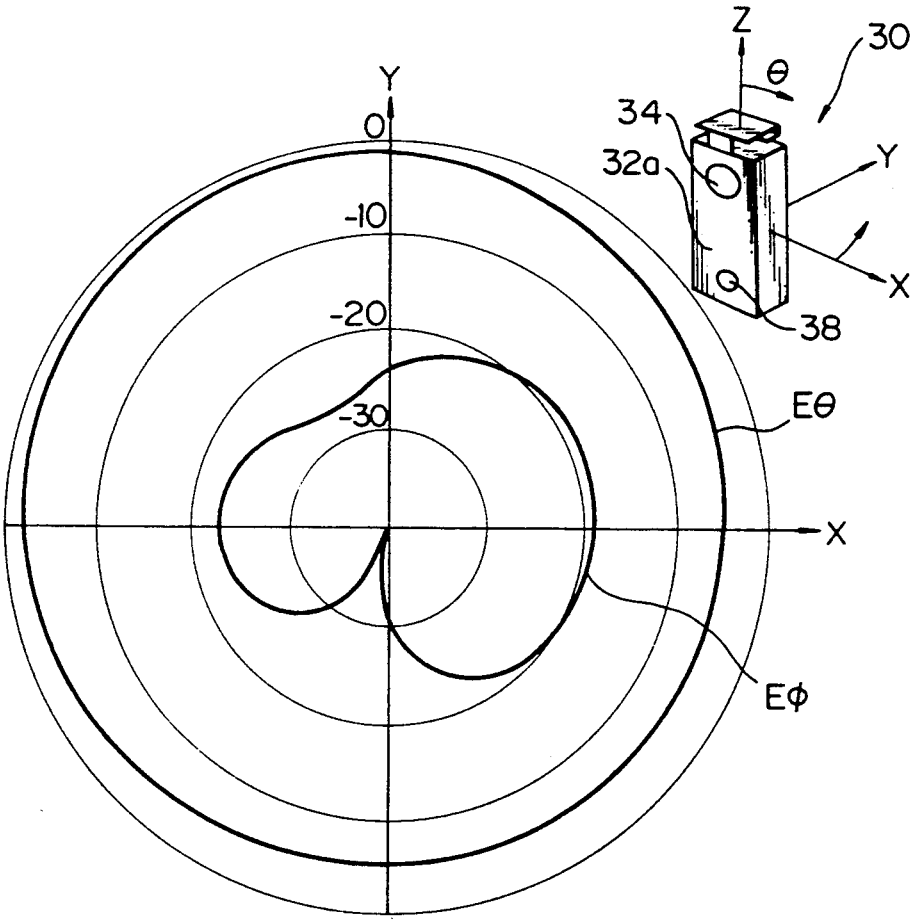
FIG. 6 is a radiation pattern associated with the illustrative embodiment and measured in a horizontal plane in free space.

FIG. 6 is a radiation pattern attainable with the antenna 30 in a horizontal plane in free space. In the diagram, Eθ and Eφ are representative of the radiation pattern of vertically polarized wave and that of horizontally polarized wave, respectively. As shown, the antenna 20 has a low radiation level at the front **32*a* where the earpiece 38 and mouthpiece 34** are located and a high radiation level at the back. This is because the portion that contributes to the radiation is located at the back.

Figure 7:
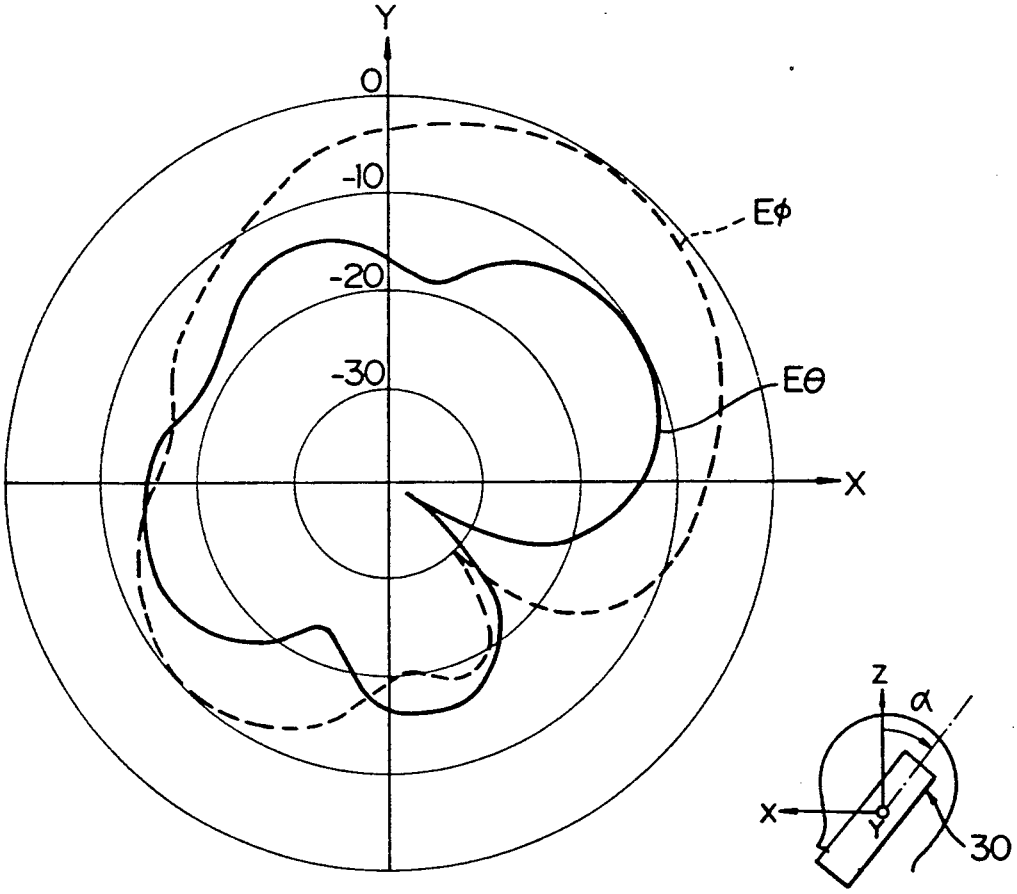
FIG. 7 is a radiation pattern diagram also associated with the embodiment and obtained during communication.
Figure 8:
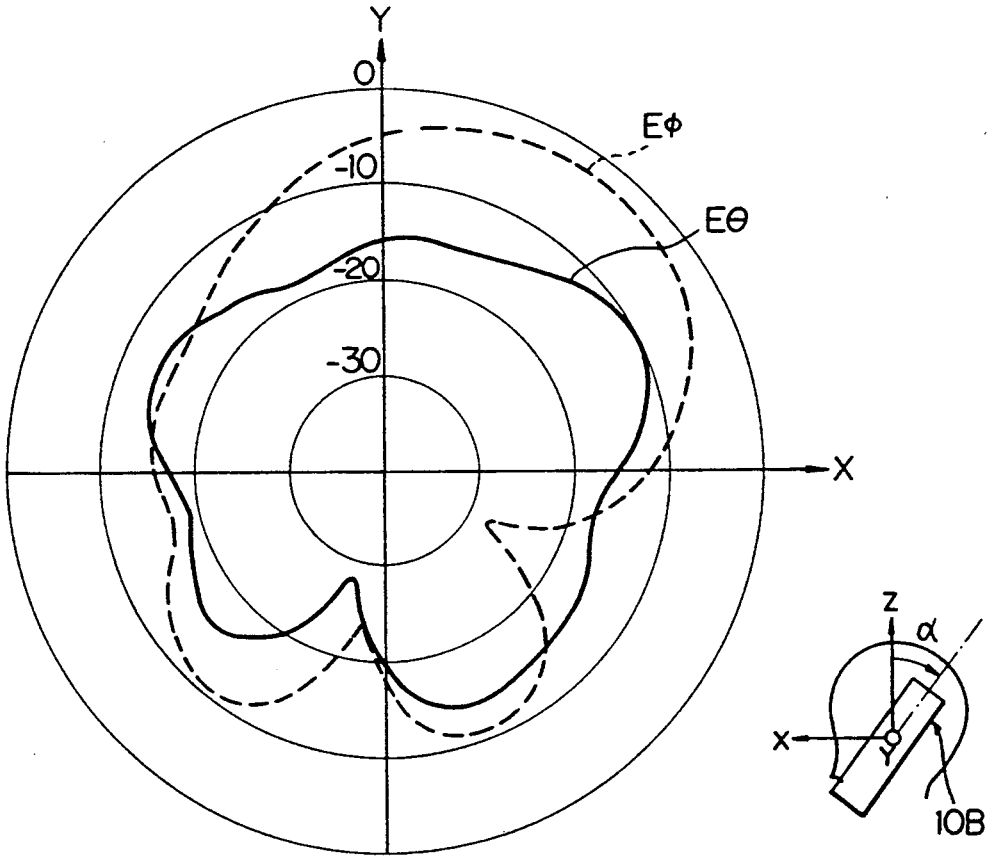
Fig.8 PRIOR ART
FIG. 8 is a radiation pattern particular to the prior art antenna shown in FIG. 4.

The radiation pattern of the apparatus 30 and that of the prior art apparatus 10B, FIG. 4, each was measured in a horizontal plane in a communicating state to determine their average gains. The experiment showed that the apparatus 30 has a 2 to 3 dB higher average gain than the apparatus 10B. Specifically, FIGS. 7 and 8 show respectively directivity diagrams associated with the apparatuses 30 and 10B and determined in a communicating state. During communication, the apparatuses 30 and 10B each was held by hand and put on the ear in a positioned inclined by 60 degrees to the vertical, as illustrated. In the figures, $\alpha$, $E\theta$ and $E\phi$ are representative of the angle of inclination of the apparatus, the radiation pattern of vertically polarized wave, and the radiation pattern of horizontally polarized wave. The average gain G is expressed as:

$$G = \frac{1}{2\pi}\left\{ \int(G\theta)d\phi + \frac{1}{Cv}\int(G\phi)d\phi \right\}$$

$$Cv = 10 \text{ dB}$$

where $G\theta$ and $G\phi$ denote gains with respect to $E\theta$ and $E\phi$, respectively. By using the above equation, the apparatus 30 of FIG. 5 and the prior art apparatus 10B of FIG. 3 were determined to have an average gain G1 of −11.4 dBd and an average gain G2 of −13.5 dBd, respectively. The illustrative embodiment, therefore, achieves a 2.1 dB (-G1−G2) higher average gain than the prior art.

Figure 9:
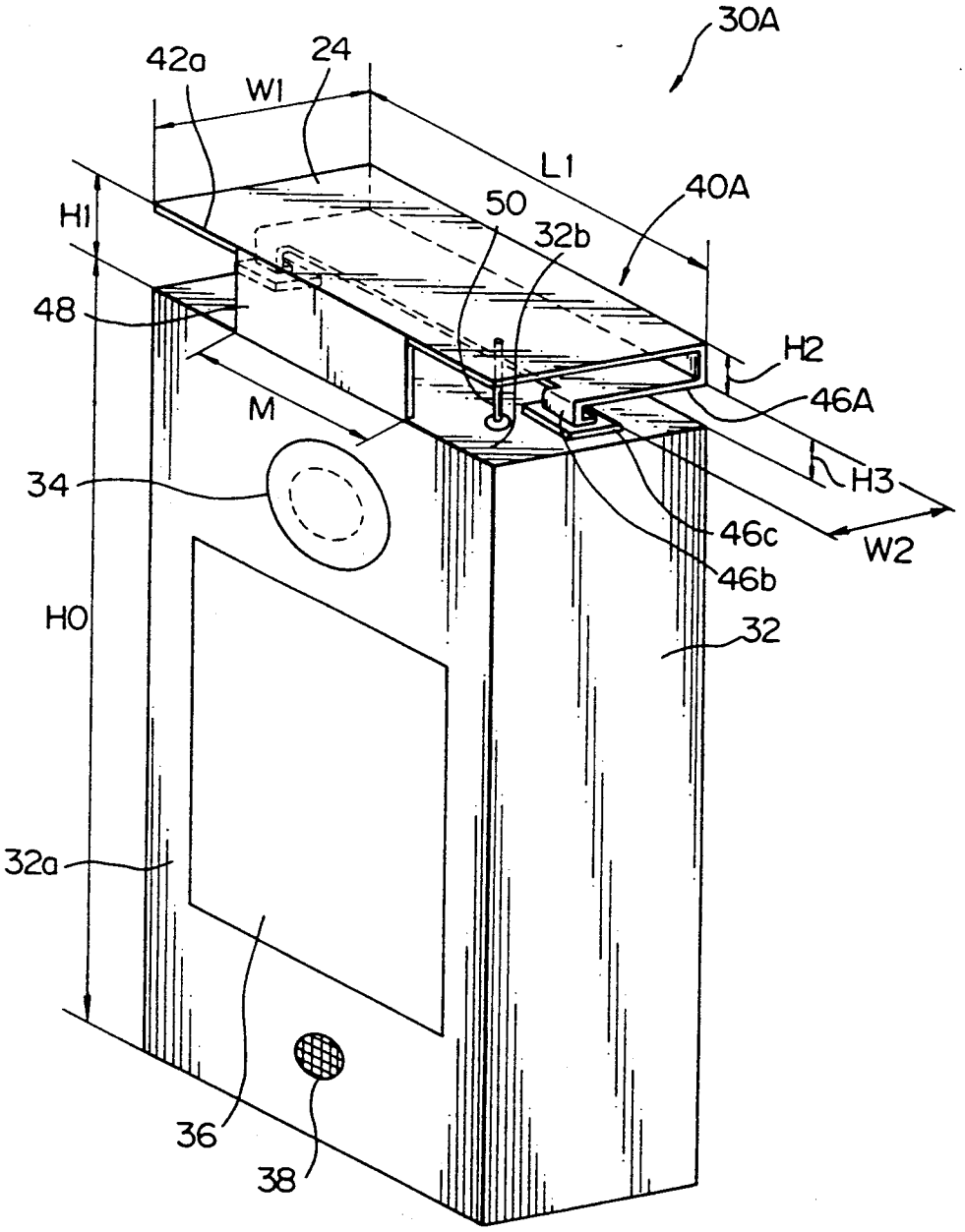
FIG. 9 is an external perspective view of an alternative embodiment of the present invention.

FIG. 9 shows an alternative embodiment of the present invention. As shown, the radio communication apparatus, generally 30A, has an antenna 40A including a third conductive plate 46A. Specifically, one side 46*a* of the third conductive plate 46 shown in FIG. 5 is either partly or entirely bent in a U configuration to form the conductive plate 46A having a bend portion or portions 46*b*. The conductive plate 46A is affixed to the upper surface 32*b* of the casing 32 with the intermediary of insulating pieces 46*c*. The apparatus 30A having such a configuration was comparable with the apparatus 30, FIG. 5, regarding the improvement over the prior art.

In summary, it will be seen that the present invention provides a radio communication apparatus which promotes easy manual operations, prevents the acoustic characteristics from being degraded, and prevents the gain from being noticeably lowered by user's head or hand during communication.

Various modifications will become possible for those skilled in the art after receiving the teachings of the present disclosure without departing from the scope thereof.

What is claimed is:

1. A mobile radio communication apparatus comprising:

a casing having an earpiece, a mouthpiece and an operating section arranged on a first surface thereof;

an antenna mounted on an upper surface of said casing and including a first conductive plate parallel to and spaced apart from the upper surface by a predetermined distance and having a length $L_1$, a second conductive plate extending perpendicularly from the first conductive plate and having a height $H_2$, and a third conductive plate extending perpendicularly from the second conductive plate and parallel to the first conductive plate;

a short-circuiting plate extending perpendicularly from one side of the first conductive plate by a height $H_1$, and having a length M as measured in a direction parallel to the length $L_1$, said short-circuiting plate having an end thereof connected and affixed to an upper end of the upper surface of said casing and a feed conductor connected to said antenna.

2. An apparatus as claimed in claim 1, wherein each of the first, second and third conductive plates comprises a rectangular plate.

3. An apparatus as claimed in claim 2, wherein the second conductive plate is bent toward the casing, said third conductive plate intervening between the first conductive plate and said upper surface of the casing.

4. An apparatus as claimed in claim 3, wherein the height $H_1$ of said short-circuiting plate is greater than the height $H_2$ of the second conductive plate.

5. An apparatus as claimed in claim 4, wherein the length M of said short-circuiting plate is at most equal to the length $L_1$ of said first conductive plate.

6. An apparatus as claimed in claim 3, wherein the third conductive plate has an end thereof partly or entirely bent in a form of a letter U to form a bent portion, the bent portion being connected and affixed to said upper surface of the casing via an insulating material.

* * * * *